US006118416A

United States Patent [19]

Nakamura et al.

[11] Patent Number: 6,118,416

[45] Date of Patent: Sep. 12, 2000

[54] METHOD OF CONTROLLING ALTERNATING CURRENT PLASMA DISPLAY PANEL WITH POSITIVE PRIMING DISCHARGE PULSE AND NEGATIVE PRIMING DISCHARGE PULSE

[75] Inventors: Tadashi Nakamura; Kazuhiro Ito, both of Tokyo, Japan

[73] Assignee: NEC Corporation, Tokyo, Japan

[21] Appl. No.: 08/941,203

[22] Filed: Sep. 30, 1997

[30] Foreign Application Priority Data

Sep. 30, 1996 [JP] Japan ..... 8-258390

[51] Int. Cl.[7] ..... G09G 3/28

[52] U.S. Cl. ..... 345/68; 345/67

[58] Field of Search ..... 345/68, 60, 61, 345/62, 63, 64, 65, 66, 69–72, 67

[56] References Cited

U.S. PATENT DOCUMENTS

| | | | |
|---|---|---|---|
| 5,247,288 | 9/1993 | Warren et al. | 345/60 |
| 5,420,602 | 5/1995 | Kanazawa | 345/67 |

FOREIGN PATENT DOCUMENTS

| | | |
|---|---|---|
| 0 657 861 | 6/1995 | European Pat. Off. . |
| 0657861 | 6/1995 | European Pat. Off. . |
| 0680087 | 11/1995 | European Pat. Off. . |
| 5-313598 | 11/1993 | Japan . |
| 7160218 | 6/1995 | Japan . |
| 7-287548 | 10/1995 | Japan . |
| 9-68946 | 3/1997 | Japan . |
| 10-83160 | 3/1998 | Japan . |

OTHER PUBLICATIONS

Y. Sano et al., "A Full–Color Surface–Discharge AC Plasma TV Display", Digest of Technical Papers, SID Int'l Symposium, May 6–10, 1991, pp. 728–731.

K. Yoshikawa et al., "A Full Color AC Plasma Display with 256 Gray Scale", *Japan Display '92*, pp. 605–608.

T. Nakamura et al., "Drive for 40–in.–Diagonal Full–Color ac Plasma Display", *SID 95 Digest*, pp. 807–810.

*Primary Examiner*—Steven J. Saras
*Assistant Examiner*—Srilakshmi K. Kumar
*Attorney, Agent, or Firm*—Sughrue, Mion, Zinn, Macpeak & Seas, PLLC

[57] ABSTRACT

A plasma display panel produces a visual image through selective firing in indicating cells, and all of the indicating cells are faintly fired in a priming discharge period before the selective firing; a positive pulse and a negative pulse are applied to scanning electrodes and sustain electrodes in such a manner as to be partially overlapped with each other, and the pulse amplitude of each pulse is relatively low so as to prevent data electrodes from undesirable discharge, thereby making the luminance in the priming discharge period small.

12 Claims, 14 Drawing Sheets

METHOD OF CONTROLLING ALTERNATING CURRENT PLASMA DISPLAY PANEL WITH POSITIVE PRIMING DISCHARGE PULSE AND NEGATIVE PRIMING DISCHARGE PULSE

FIELD OF THE INVENTION

This invention relates to an alternating current plasma display panel and, more particularly, to a method of controlling the alternating current memory driving plasma display panel.

DESCRIPTION OF THE RELATED ART

The plasma display panel has various attractive features such as fully flat simple structure, large in contrast without flicker, wide screen, fast response and reproduction of multicolor image by using various kinds of phosphor material. Research and development efforts have been made on the plasma display panel for use in a display for a compact computer unit and a color image reproduction.

Two controlling methods are known. One of the controlling methods uses alternating current for discharging between electrodes covered with dielectric layers, and is hereinbelow referred to as "alternating current discharging technology". The other of the controlling methods uses direct current for discharging between electrodes exposed to the discharge space, and is hereinbelow referred to as "direct current discharging technology". The alternating current discharging technology is further broken down into two categories, which are called as "memory driving technology" and "refresh technology". The memory driving type alternating current discharging flat panel display uses memories of discharging cells. However, the memories are not used in the refresh type alternating current discharging flat display panel.

The luminance of the image reproduced on the screen is variable by changing the repetition of discharging or the number of pulses. If the display capacitance is increased, the refresh type alternating current discharging flat display panel decreases the luminance, and, for this reason, the refresh type alternating current technology is applied to a plasma display panel with small display capacitance.

FIG. 1 illustrates the structure of an indicating cell incorporated in the prior art alternating current discharging plasma display panel. The indicating cell comprises a face plate 1 and a back plate 2, and these plates 1 and 2 are formed of glass. A transparent scanning electrode 3 and a transparent sustain electrode 4 are formed on the face plate 1, and trace electrodes 5 and 6 are laminated on the transparent scanning/sustain electrodes 3/4, respectively, so as to reduce the resistance therealong. The transparent scanning/sustaining electrodes 3/4 and the trace electrodes 5/6 are covered with a dielectric layer 7, and the dielectric layer 7 in turn is covered with a protective layer 8. The protective layer 8 is formed of magnesium oxide, and prevents the dielectric layer 7 from discharging.

On the other hand, a data electrode 9 is formed on the back plate 2, and extends in a perpendicular direction to the transparent scanning/sustaining electrodes 3/4. The data electrode 9 is covered with a dielectric layer 10, and partition walls 11 space the dielectric layer 8 from the dielectric layer 12. The dielectric layer 10 and the partition walls 11 are covered with phosphor layers 12. The phosphor layer 12 converts ultra-violet light to visible light. Then, discharging space 13 is formed between the dielectric layer 8 and the phosphor layer 12, and is filled with discharging gas. The discharging gas contains helium, neon, xenon or gaseous mixture thereof, and produces the ultra-violet light under the discharging.

A piece of image is produced by the indicating cell as follows. A pulse signal over a threshold level is applied between the transparent scanning electrode 3 and the data electrode 9 so that the discharging takes place. Positive electric charge and negative electric charge are attracted toward the surface of the dielectric layer 7 and the surface of the dielectric layer 10 depending upon the polarity of the pulse signal, and are accumulated thereon. The wall potential due to the accumulation of the electric charge is opposite in polarity to the pulse signal, and the effective potential in the indicating cell is decreased by growing the discharge. For this reason, even if the pulse signal maintains the potential level constant, it is impossible to continue the discharging, and the discharging is finally terminated.

If the sustain pulse signal identical in the polarity with the wall potential is applied between the transparent scanning electrode 3 and the transparent sustain electrode 4, the potential level equal to the wall potential is overlapped as an effective potential level, and the total potential level exceeds the threshold. Thus, the sustain pulse signal is alternately applied between the transparent scanning electrode 3 and the transparent sustain electrode 4 so as to maintain the discharging. This technology is called as the memory driving technology.

When a low-level wide pulse signal or a narrow erase pulse signal is applied between the transparent scanning electrode 3 and the transparent sustain electrode 4, the low-level wide pulse or the narrow erase pulse signal stops the discharging. The narrow erase pulse signal is same in potential level as the sustain pulse, and the low-level wide pulse or the narrow erase pulse signal neutralizes the wall potential.

FIG. 2 illustrates the layout of indicating cells 14. The indicating cells 14 are arranged in rows and columns, and form a screen of the prior art plasma display panel 15 for producing a visual image. The rows of indicating cells 14 are associated with the scanning electrodes Sc1, Sc2, . . . Scj and the sustain electrodes Su1, Su2, . . . Suj, and the scanning electrodes Sc1, Sc2, . . . Scj are alternated with the sustain electrodes Su1, Su2, . . . Suj. On the other hand, the columns of indicating cells 14 are associated with the data electrodes D1, D2, . . . Dk, and the scanning/sustain electrodes Sc1/Su1, Sc2/Su2, Scj/Suj and the data electrodes D1,D2, . . . Dk defines cell locations assigned to the indicating cells 14, respectively.

The prior art plasma display 15 is controlled as shown in FIG. 3. The controlling technique shown in FIG. 3 is disclosed by T. Nakamura et. al. in "Drive for 40-in.-Diagonal Full-Color ac Plasma Display", Society for Information Display International Symposium Digest of Technical Papers, vol. XXVI, pages 807 to 810, and is hereinbelow referred to as "first prior art controlling method".

In FIG. 3, a sustain pulse signal Wu is applied to all of the sustain electrodes Su1, Su2, . . . Suj, scanning pulse signals Ws1, Ws2, . . . Wsj are respectively applied to the scanning electrodes Sc1, Sc2, . . . Scj, and a driving pulse signal Wd is selectively applied to the data electrodes D1, D2, . . . Dk. Each frame consists of a priming discharge period, a writing period and a sustaining period, and the frame is repeated for producing a visual image on the screen.

The priming discharge produces active particles and wall charges in the discharge gas, and the active particles and the wall charges make the write-in discharging characteristics in the write discharge period stable. A priming discharge pulse Pp is firstly applied to all the sustain electrodes Su1, Su2, . . . Suj, and the priming discharge takes place in all the indicating cells 14. Subsequently, a priming erase pulse Ppe is applied to all the scanning electrodes Sc1, Sc2, . . . Scj. The priming erase pulse Ppe causes erasing discharge to take place, and extinguishes either wall charge against the write discharge and the sustain discharge.

The write discharge period follows the priming discharge period. In the write discharge period, a scanning pulse Pw is sequentially applied to all the scanning electrodes Sc1, Sc2, . . . Scj, and a driving pulse Pd is selectively applied to the data electrodes D1, D2, . . . Dk in synchronism with the scanning pulse Pw. For example, if the write discharging is expected to the indicating cell at the crossing point between the scanning electrode Sc1 and the data electrode D1, the scanning pulse Pw and the driving pulse Pd are concurrently applied to the scanning electrode Sc1 and the data electrode D1, and cause the write discharge to take place therebetween. The wall charge is generated during the write discharge.

The sustaining discharge period follows the write discharge period. In the sustaining discharge period, a sustain pulse Pc repeatedly is applied to all of the sustain electrodes Su1, Su2, . . . Suj, and a sustain pulse Ps is also repeatedly applied to all of the scanning electrodes Sc1, Sc2, . . . Scj. The sustain pulse Ps is delayed from the sustain pulse Pc at 180 degrees. The sustain pulses Ps and Pc maintain the write discharge, and the selected indicating cells are brightened at certain luminance in the sustaining discharge period.

FIGS. 4A and 4B illustrate the wall charges in the priming discharge period. As described hereinbefore, the priming pulse Pp is applied to all the sustain electrodes 4. The priming pulse Pp is negative potential level, and the positive wall charge (+) is attracted to the surface beneath the sustain electrodes 4. On the other hand, the negative wall charge (−) is accumulated on the surface beneath the scanning electrodes 3 and the surface over the data electrodes 9 as shown in FIG. 4A.

However, when the erase pulse Ppe is applied to the scanning electrodes 3, the erase discharge takes place between the scanning electrodes 3 and the associated sustain electrodes 4, and cancels most of the wall potential due to the positive wall charge (+) beneath the sustain electrodes 4 and the negative wall charge (−) beneath the scanning electrodes 3. As a result, a large amount of the negative wall charge (−) is left on the surface over the data electrode 9 as shown in FIG. 4B.

FIG. 5 illustrates another prior art controlling sequence disclosed by K. Yoshikawa et al in "A Full Color AC Plasma Display with 256 Gray Scale", JAPAN DISPLAY '92, pages 605 to 608, and the controlling technology disclosed therein is hereinbelow referred to as "second controlling method". Each frame is also divided into a priming discharge period, a write discharge period and a sustaining discharge period. Although the paper refers to the priming discharge period and the write discharge period as steps 1–3 and step 4 in the addressing period, terms "priming discharge period" and "write discharge period" are used in the following description so as to make the relation between the first prior art controlling sequence and the second prior art controlling sequence clear. The sustain electrodes Su1, Su2, . . . Suj and the scanning electrodes Sc1, Sc2, . . . Scj are corresponding to x-electrodes and y-electrodes, respectively, and the data electrodes D1, D2, . . . Dk are referred to as address electrodes.

A driving pulse Wx, a driving pulse signal Wy1 . . . Wy480 and a driving pulse signal Wa are respectively applied to the x-electrodes, the y-electrodes and the address electrodes.

In the priming discharge period, a sustain-erase pulse Psus is applied to the x-electrodes in order to erase the wall charge accumulated in the previous field, and a positive priming discharge pulse Ppc is applied to the y-electrodes Y1 to Y480. Subsequently, a positive priming erase discharge pulse Ppec is applied to the x-electrodes, and most of the wall potential is removed from the surface between the x-electrodes and the y-electrodes. The positive wall charge is accumulated on the surface over the address electrodes, and decreases write-in potential level in the writing discharge period.

It is desirable for the alternating current plasma display panel to restrict the photo-emission as low in luminance as possible, because the contrast of an image is determined on the basis of the priming discharge corresponding to the black level. The larger the contrast is, the higher the image quality is.

The first prior art controlling method encounters a problem in large luminance in the priming discharge period. This is because of the fact that the priming discharge pulse Pp causes the discharge not only between the scanning electrodes Sc1, Sc2, . . . Scj and the sustain electrodes Su1, Su2, . . . Suj but also between the sustain electrodes Su1, Su2, . . . Suj and the data electrodes D1, D2, . . . Dk in the priming discharge period. Another problem inherent in the first controlling method is that the write pulse Pw requires a large pulse amplitude. This is because of the fact that the large amount of negative wall charge (1) and the positive wall charge (+) are left on the surface over the data electrode 9 and beneath the scanning/sustain electrodes 3/4 as shown in FIG. 4B. Thus, an image produced through the first prior art controlling method is small in contrast and less fine due to misfiring at certain indicating cells.

On the other hand, the write pulse Pw is relatively low by virtue of the positive wall charge accumulated over the address electrodes, and the second prior art controlling method overcomes one of the problems inherent in the first prior art controlling method. However, the small contrast is still problem in the second prior art controlling method. This is because of the fact that strong discharge takes place between the address electrodes and the scanning electrodes in the priming discharge period due to the positive bias voltage on the address electrodes. Moreover, the strong discharge is causative of serious ion bombardment against the phosphor layers on the address electrodes, and the plasma display panel is less durable.

SUMMARY OF THE INVENTION

It is therefore an important object of the present invention to provide a method of controlling a plasma display panel which makes a write-in pulse low.

To accomplish the object, the present invention proposes to apply a first priming discharge pulse and a second priming discharge pulse opposite in polarity to sustaining electrodes and scanning electrodes in such a manner as to be at least partially overlapped with each other.

In accordance with one aspect of the present invention, there is provided a method of controlling a plasma display panel having a plurality of scanning electrodes, a plurality of sustaining electrodes respectively paired with the plurality of scanning electrodes and a plurality of data electrodes defining a plurality of indicating cells together with the pairs of scanning and sustaining electrodes, and the method comprises the steps of respectively applying a first priming discharge pulse of a first polarity and a second priming discharge pulse of a second polarity opposite to the first polarity with respect to a potential level on the plurality of data electrodes to the plurality of sustaining electrodes and the plurality of scanning electrodes in such a manner that at least a part of the first priming discharge pulse is overlapped with a part of the second priming discharge pulse in a priming discharge period, selecting certain indicating cells from the plurality of indicating cells for firing the certain indicating cells through a write discharge selectively generated between the plurality of scanning electrodes and the plurality of data electrodes in a writing discharge period after the priming discharge period, and continuing the firing in the certain indicating cells by applying a sustain pulse to the plurality of scanning electrodes and the plurality of sustaining electrodes in a sustaining discharge period after the writing discharge period.

A priming erase discharge pulse may be further applied to the scanning electrodes in the priming discharge period.

In accordance with another aspect of the present invention, there is provided a method of controlling a plasma display panel having a plurality of scanning electrodes, a plurality of sustaining electrodes respectively paired with the plurality of scanning electrodes and a plurality of data electrodes defining a plurality of indicating cells together with the pairs of scanning and sustaining electrodes, and the method comprises the steps of applying a priming discharge pulse of a negative potential level with respect to a potential level on the plurality of data electrodes to one of the plurality of sustaining electrodes and the plurality of scanning electrodes in the priming discharge period, respectively applying a first priming erase discharge pulse of a positive potential level with respect to the plurality of data electrodes and a second priming erase discharge pulse of a negative potential level with respect to the plurality of data electrodes to the aforesaid one of the plurality of sustaining electrodes and the plurality of scanning electrodes and the other of the plurality of sustaining electrodes and the plurality of scanning electrodes in such a manner that a part of the first priming erase discharge pulse is overlapped with a part of the second priming erase discharge pulse after the priming discharge pulse in the priming discharge period, selecting certain indicating cells from the plurality of indicating cells for firing the certain indicating cells through a write discharge selectively generated between the plurality of scanning electrodes and the plurality of data electrodes in a writing discharge period after the priming discharge period, and continuing the firing in the certain indicating cells by applying a sustain pulse to the plurality of scanning electrodes and the plurality of sustaining electrodes in a sustaining discharge period after the writing discharge period.

BRIEF DESCRIPTION OF THE DRAWINGS

The features and advantages of the plasma display panel will be more clearly understood from the following description taken in conjunction with the accompanying drawings in which.

DESCRIPTION OF THE PREFERRED EMBODIMENTS

First Embodiment

Figure 1:
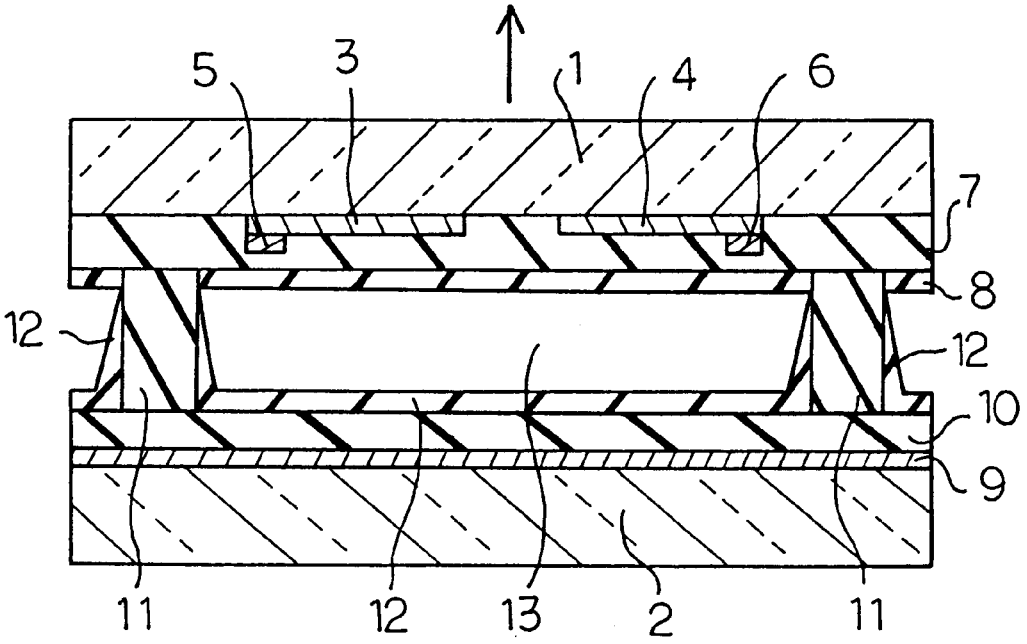
Fig. 1 PRIOR ART
FIG. 1 is a cross sectional view showing the structure of the prior art alternating current plasma display panel.
Figure 2:
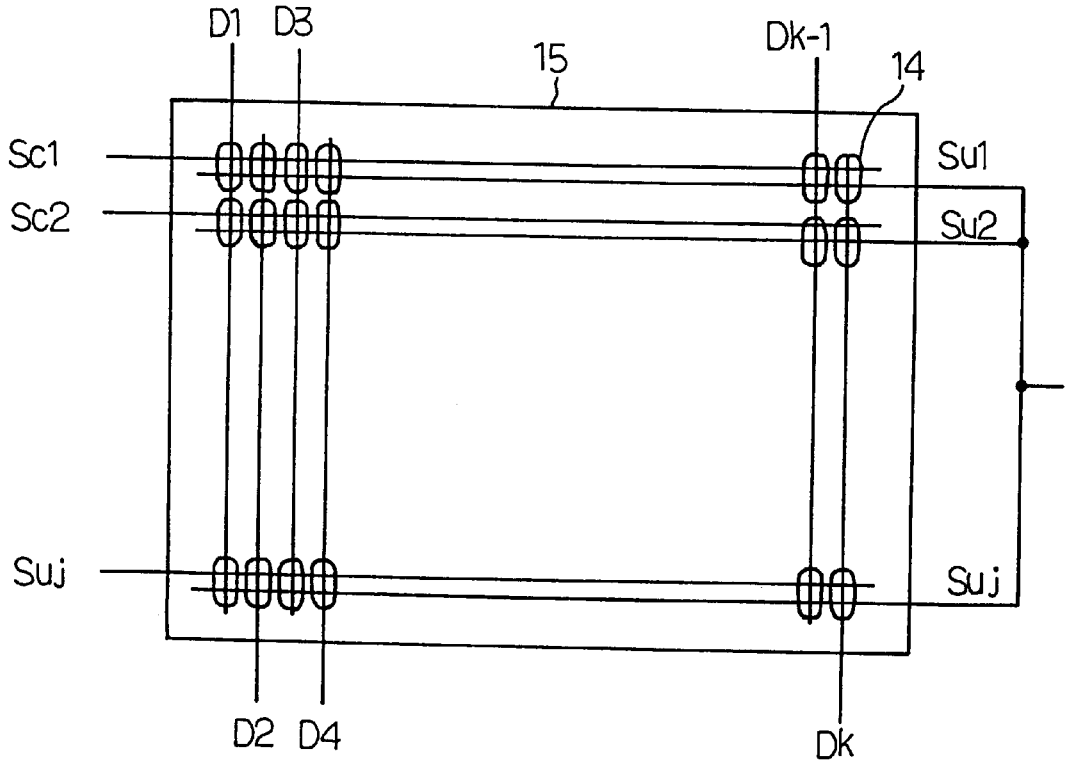
Fig. 2 PRIOR ART
FIG. 2 is a plan view showing the layout of the indicating cells incorporated in the prior art alternating current plasma display panel.
Figure 3:
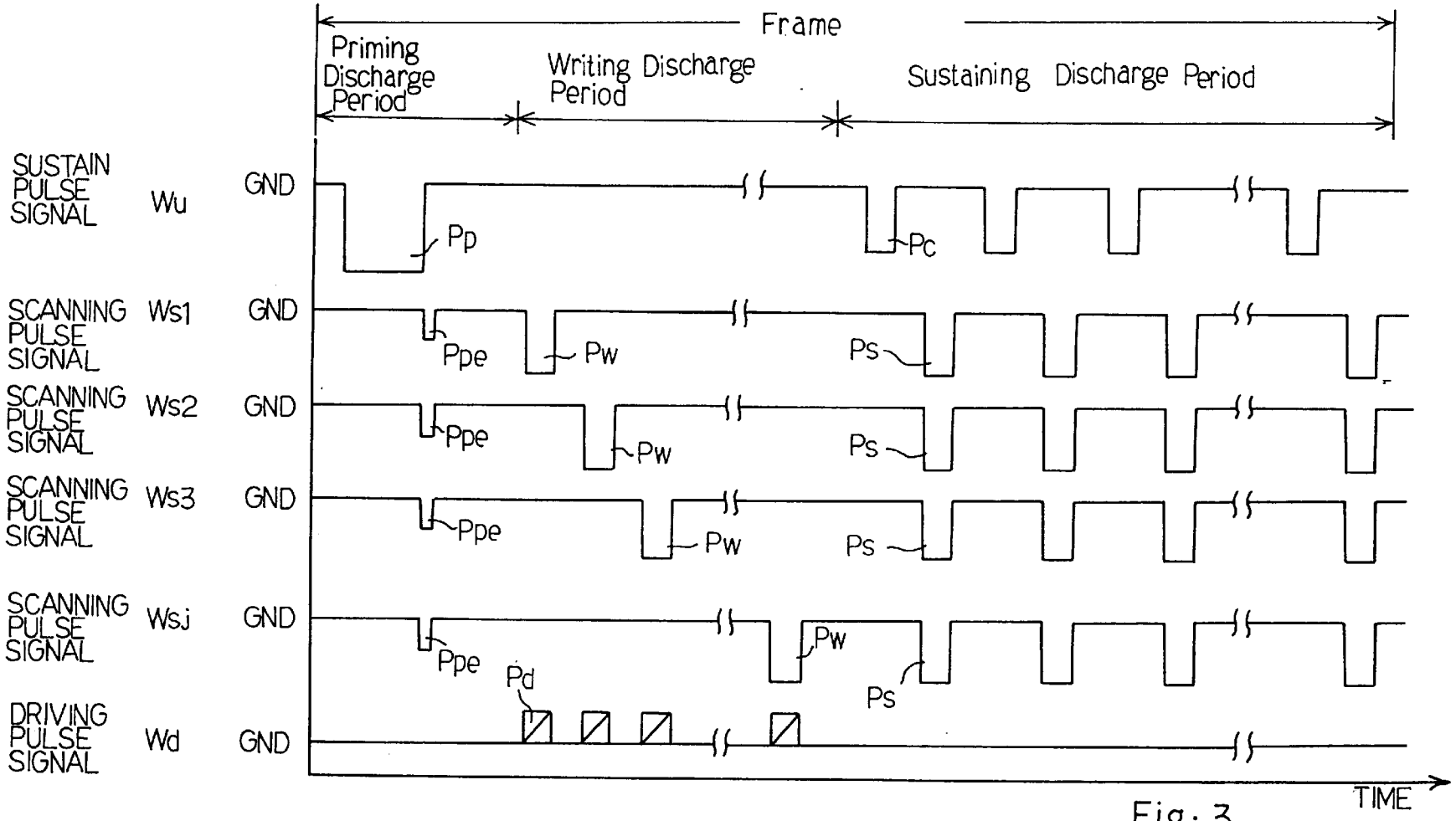
Fig. 3 PRIOR ART
FIG. 3 is a timing chart showing the prior art controlling sequence for the plasma display panel.
Figure 4A:
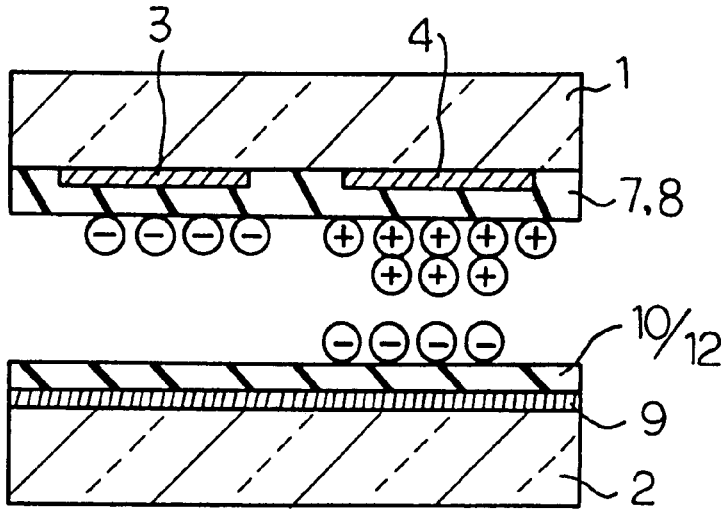
Fig. 4A PRIOR ART
FIGS. 4A and 4B are cross sectional views showing the variation of the wall charges in and after the erasing discharge.
Figure 4B:
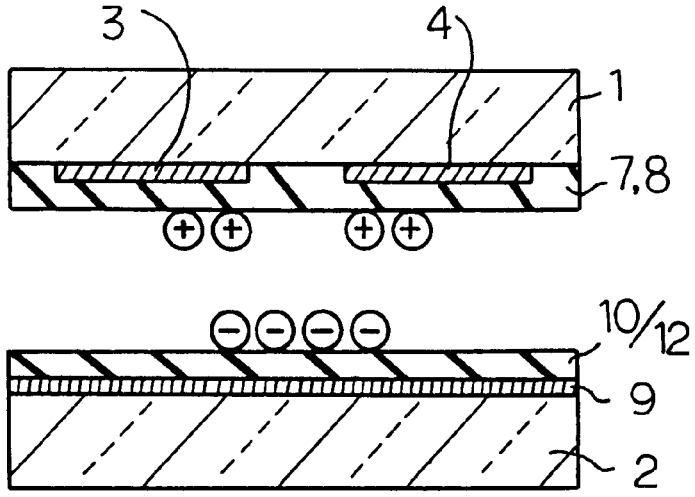
Fig. 4B PRIOR ART
Figure 5:
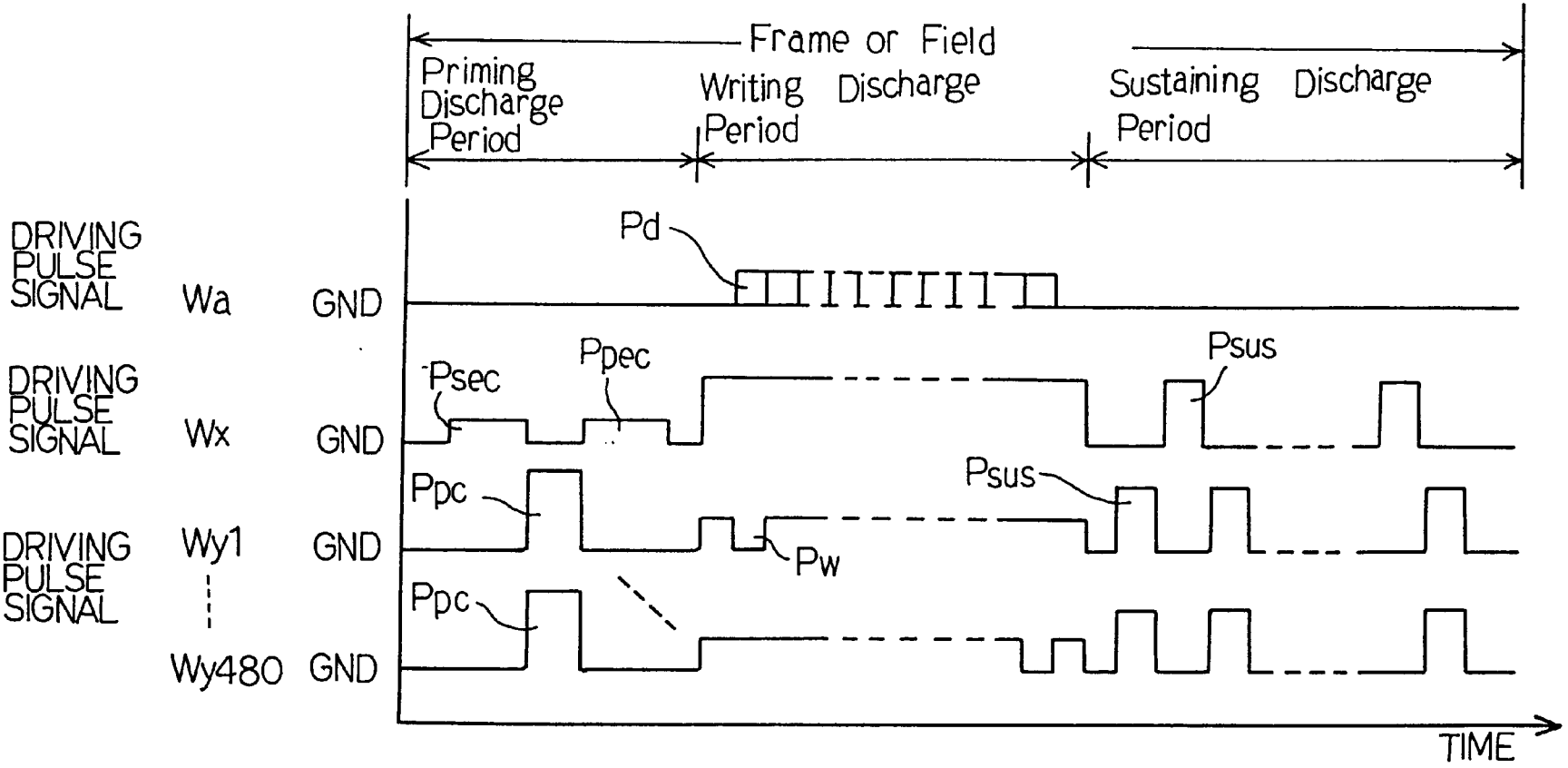
Fig. 5 PRIOR ART
FIG. 5 is a timing chart showing another prior art controlling sequence for the plasma display panel.
Figure 6:
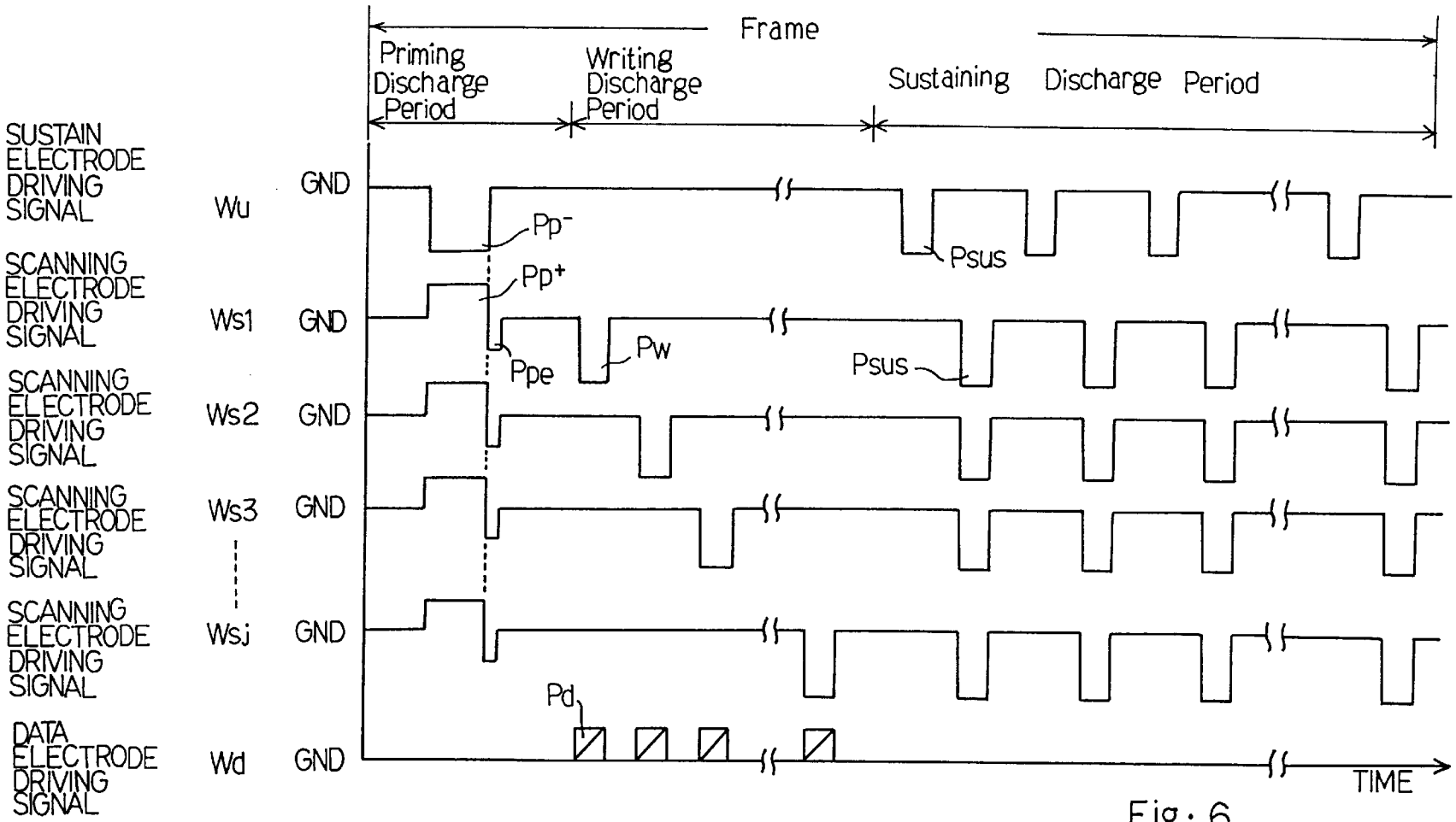
FIG. 6 is a timing chart showing a controlling sequence for a plasma display panel according to the present invention.

Referring to FIG. 6 of the drawings, a controlling sequence embodying the present invention divides each frame into a priming discharge period, a writing discharge period and a sustaining discharge period. The controlling sequence is applied to an alternating current plasma display panel similar in structure to that shown in FIG. 1 and 2. For this reason, component parts of the plasma display panel controlled by the sequence are labeled with the references designating corresponding component parts of the plasma display panel shown in FIGS. 1 and 2 in the following description.

A sustain electrode driving signal Wu is concurrently applied to all the sustain electrodes Su1, Su2, . . . Suj, and the scanning electrode driving signals Ws1, Ws2, Ws3, . . . Wsj are respectively applied to the scanning electrodes Sc1, Sc2, Sc3, . . . Scj. Although a data electrode driving signal Wd is drawn on a single line, the data electrode driving signal Wd is selectively applied to the data electrodes D1, D2, . . . Dk. The sustain/scanning electrodes Su1/Sc1, Su2/Sc2, . . . Suj/Scj and the data electrodes D1, D2, D3, . . . Dk define cell locations respectively assigned to indicating cells.

Priming discharge is concurrently produced in all of the indicating cells during the priming discharge period. However, the write-in discharge selectively takes place in the indicating cells during the writing discharge period in response to an image carrying signal, and an image is produced by the indicating cells under the write-in discharge. The selected indicating cells maintain the discharge in the sustaining discharge period.

In detail, a negative priming discharge pulse Pp− is firstly applied to all of the sustain electrodes Su1, Su2, . . . Suj. The negative priming discharge pulse Pp− has the pulse amplitude ranging between −170 volts and −200 volts and the pulse width ranging between 5 microsecond and 20 microsecond. On the other hand, a positive priming discharge pulse Pp+ and a negative priming erase discharge pulse Ppe are successively applied to the scanning electrodes Sc1, Sc2, Sc3, . . . Scj. The positive priming discharge pulse Pp+ has the pulse amplitude ranging between 170 volts and 200 volts and the pulse width ranging from 5 microsecond to 20 microsecond. On the other hand, the negative priming erase discharge pulse Ppe has the pulse amplitude ranging between −50 volts and −150 volts. When the difference between the negative priming discharge pulse Pp− and the positive priming discharge pulse Pp+ exceeds the firing potential, the priming discharge takes place between the sustain electrodes Sc1, Sc2, . . . Scj and the scanning electrodes Su1, Su2, . . . Suj. However, any discharge does not take place between the scanning electrodes Sc1, Sc2, . . . Scj and the data electrodes D1, D2 . . . Dk and between the sustain electrodes Su1, Su2, . . . Suj and the data electrodes D1, D2, . . . Dk, because the potential difference therebetween do not exceed the firing potential. Thus, the discharge is restricted in the priming discharge period, and the luminance of the indicating cells is low.

The negative priming erase discharge pulse Ppe is applied in synchronism with the pulse fall of the positive priming discharge pulse Pp+ and the pulse rise of the negative priming discharge pulse Pp−. The negative priming erase pulse Ppe and the internal potential already produced due to the wall charge cause erasing discharge to take place. The pulse with of the negative priming erase discharge pulse Ppe is as narrow as the minimum erase pulse width ranging from 0.5 microsecond to 2 microsecond and, preferably, from 0.5 microsecond to 1 microsecond, Even though the negative priming erase pulse Ppe is applied to the scanning electrodes Sc1, Sc2, . . . Scj, any discharge takes place between the scanning electrodes Sc1, Sc2, . . . Scj and the data electrodes D1, D2, . . . Dk, because the potential difference therebetween is less than the firing potential. For this reason, undesirable bombardment does not erode the phosphor layers 12 over the data electrodes D1, D2, . . . Dk.

Figure 7A:
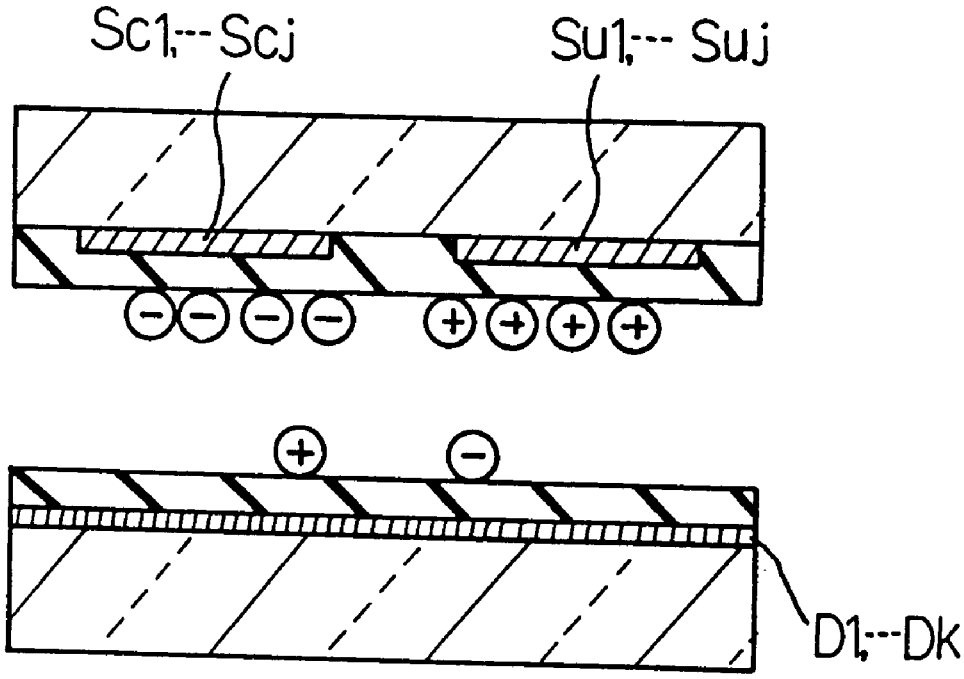
FIGS. 7A and 7B are cross sectional views showing wall charge before and after priming erase discharge.

After the priming discharge between the sustain electrodes Su1, Su2, . . . Suj and the scanning electrodes Sc1, Sc2, . . . Scj, a large amount of the positive wall charge (+) and a large amount of the negative wall charge (−) are respectively left on the surface beneath the sustain electrodes Su1, Su2, . . . Suj and the surface beneath the scanning electrode Sc1, Sc2, . . . Scj as shown in FIG. 7A. On the other hand, a small amount of the negative wall charge (−) and a small amount of the positive wall charge (+) are left on the surface over the data electrodes D1, D2, . . . Dk close to the sustain electrodes Su1 to Suj and on the surface over the data electrodes D1, D2, . . . Dk close to the scanning electrodes Sc1, Sc2, . . . Scj. Thus, the wall charge beneath the sustain/scanning electrodes Su1/Sc1 to Suj/Scj is more than the wall charge over the data electrodes D1 to Dk, because the potential different between the sustain/scanning electrodes and the data electrodes is about a half of the potential difference between the sustain electrodes Su1, . . . Suj and the scanning electrodes Sc1, . . . Scj.

Figure 7B:
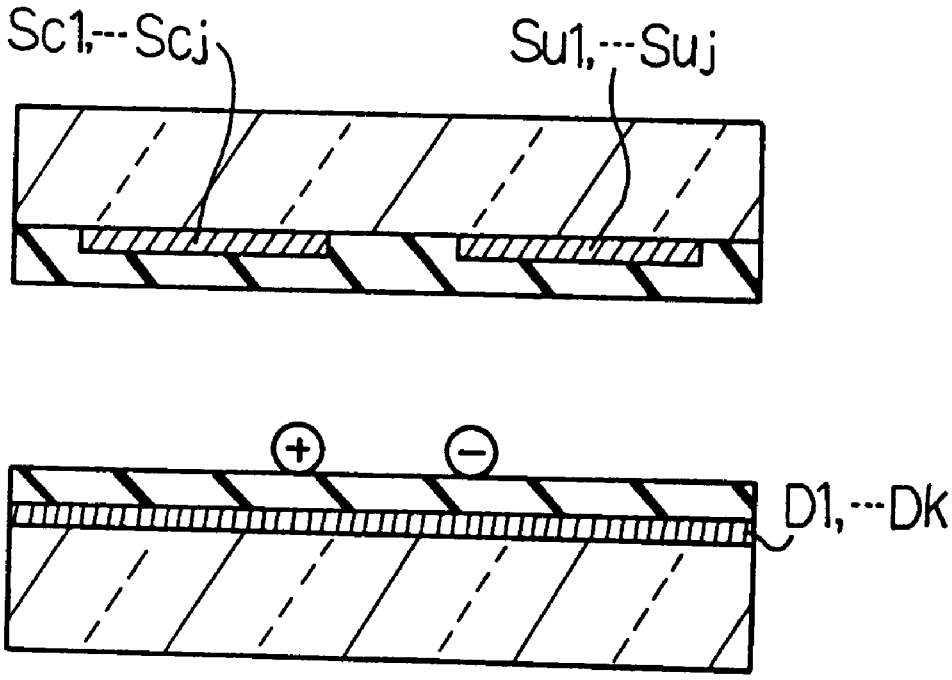

The priming erase discharge erases the positive wall charge (+) and the negative wall charge (−) from the surface beneath the sustain electrode Su1, Su2, . . . Suj and the surface beneath the scanning electrodes Sc1, Sc2, . . . Scj as shown in FIG. 7B. However, the small amount of wall charge is left on the surface over the data electrodes D1, D2, . . . Dk.

Subsequently, a negative write-in pulse Pw is sequentially applied to the scanning electrodes Sc1, Sc2, . . . Scj, and a positive data pulse Pd is selectively applied to the data electrodes D1, D2, . . . Dk in synchronism with the negative write-in pulse Pw on the associated scanning electrodes Sc1, Sc2, . . . Scj. The negative write-in pulse Pw and the positive data pulse Pd allow the indicating cells to emit light through write-in discharge in the writing discharge period, and produce an image on the screen. As described hereinbefore, the positive priming discharge pulse Pp(+) on the scanning electrodes Sc1, Sc2, . . . Scj causes the surface over the data electrodes D1, D2, . . . Dk to accumulate the small amount of positive wall charge (+), and the positive wall charge (+) makes the indicating cells to exceed the firing potential under a low pulse amplitude of the write-in pulse Pw.

A sustaining discharge period follows the writing discharge period, and a negative sustain pulse Psus is alternately applied to the sustain electrodes Su1, Su2, . . . Suj and the scanning electrodes Sc1, Sc2, . . . Scj as similar to the prior art controlling sequence. The negative sustain pulse Psus causes the selected indicating cells to maintain the image on the screen.

As will be appreciated from the foregoing description, the priming discharge takes place only between the internal potential due to the wall charge and the scanning electrodes Sc1 to Scj, and the negative priming discharge pulse Pp− and the positive priming discharge pulse Pp+ do not allow the priming discharge to take place between the sustain/scanning electrodes Su1/Sc1 to Suj/Scj and the data electrodes D1 to Dk. This results in restriction of luminance in the priming discharge period and prevention from the bombardment against the phosphor layers 12. Moreover, the negative priming erase discharge pulse Ppe effectively eliminates the wall charge from the surface beneath the sustaining/scanning electrodes Su1 to Su1/Sc1 to Scj; however, the positive wall charge (+) is left on the surface over the data electrodes D1 to Dk close to the scanning electrodes Sc1 to Scj. The potential due to the positive wall charge (+) is added to the write-in pulse Pw, and the write-in pulse Pw is decreased in pulse amplitude.

Second Embodiment

Figure 8:
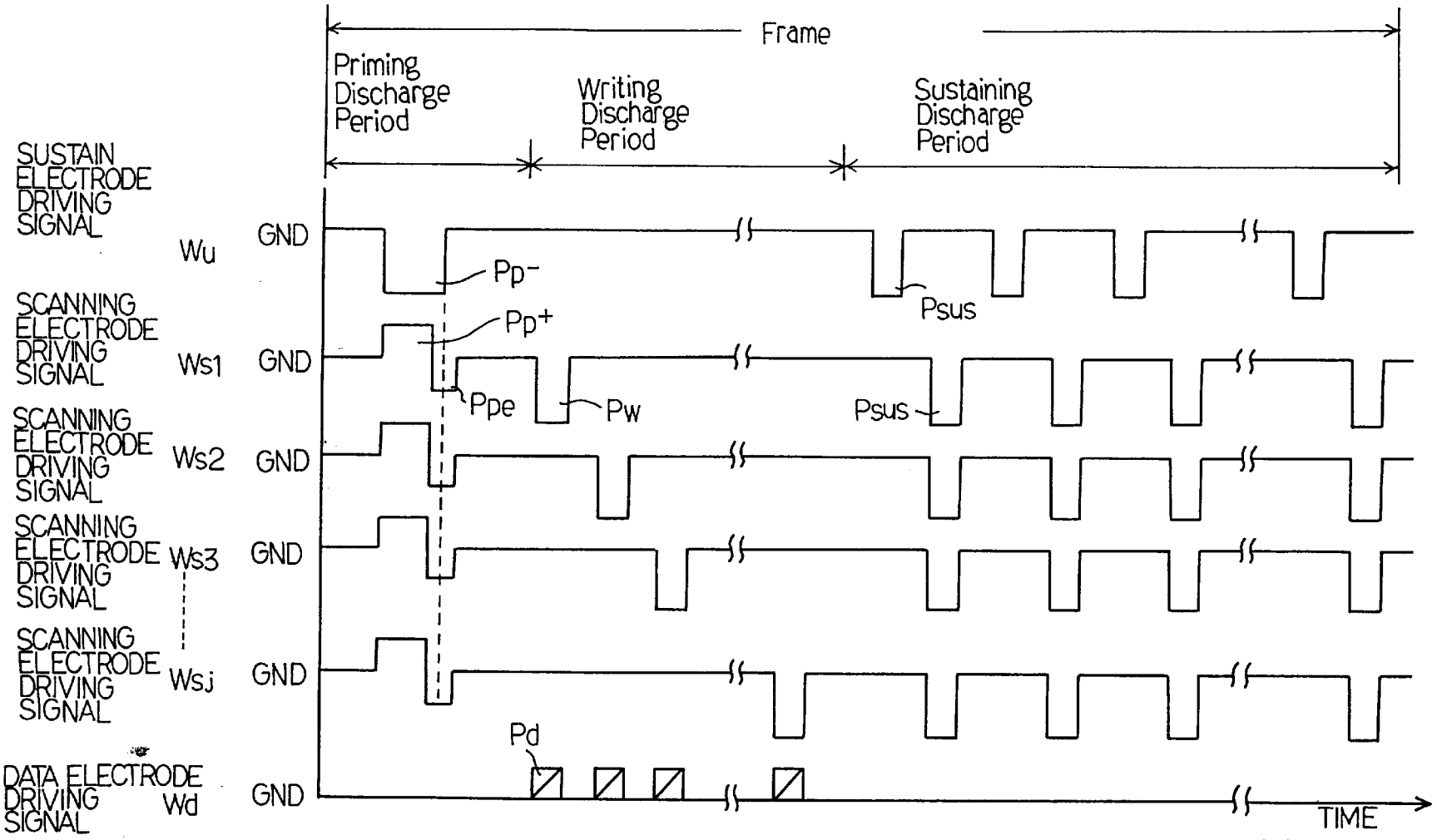
FIG. 8 is a timing chart showing another controlling sequence for a plasma display panel according to the present invention.

Turning to FIG. 8 of the drawings, another method for a frame is also divided into a priming discharge period, a writing discharge period and a sustaining discharge period. The controlling method implementing the second embodiment is similar to the first embodiment except for a negative erase discharge pulse Ppe. For this reason, description is focused on the negative erase discharge pulse Ppe.

In the controlling sequence shown in FIG. 8, the negative priming discharge pulse Pp+ and the positive priming discharge pulse Pp− are concurrently applied to the sustain electrodes Su1 to Suj and the scanning electrodes Sc1 to Scj as similar to the first embodiment. The negative erase discharge pulse Ppe is fallen in synchronism with the fall of the positive priming discharge pulse Pp+, and the negative erase discharge pulse Ppe is recovered to the ground level after the rise of the negative priming discharge pulse Pp−. Thus, the negative erase discharge pulse Ppe delays the rise of the negative priming discharge pulse Pp− from the fall of the positive priming discharge pulse Pp+. The time period between the fall of the positive priming discharge pulse Pp+ and the rise of the negative priming discharge pulse Pp− ranges from 1 microsecond to 5 microseconds, and the time period between the rise of the negative priming discharge pulse Pp− and the rise of the negative erase discharge pulse Ppe is as short as the minimum erase pulse width ranging from 0.5 microsecond to 2 microsecond and, preferably, from 0.5 microsecond to 1 microsecond.

The delayed pulse control is desirable for the power source of the plasma display panel, because the peak current is reduced. Thus, the controlling sequence effectively decreases the peak current and, accordingly, noise on the power supply line.

Third Embodiment

Figure 9:
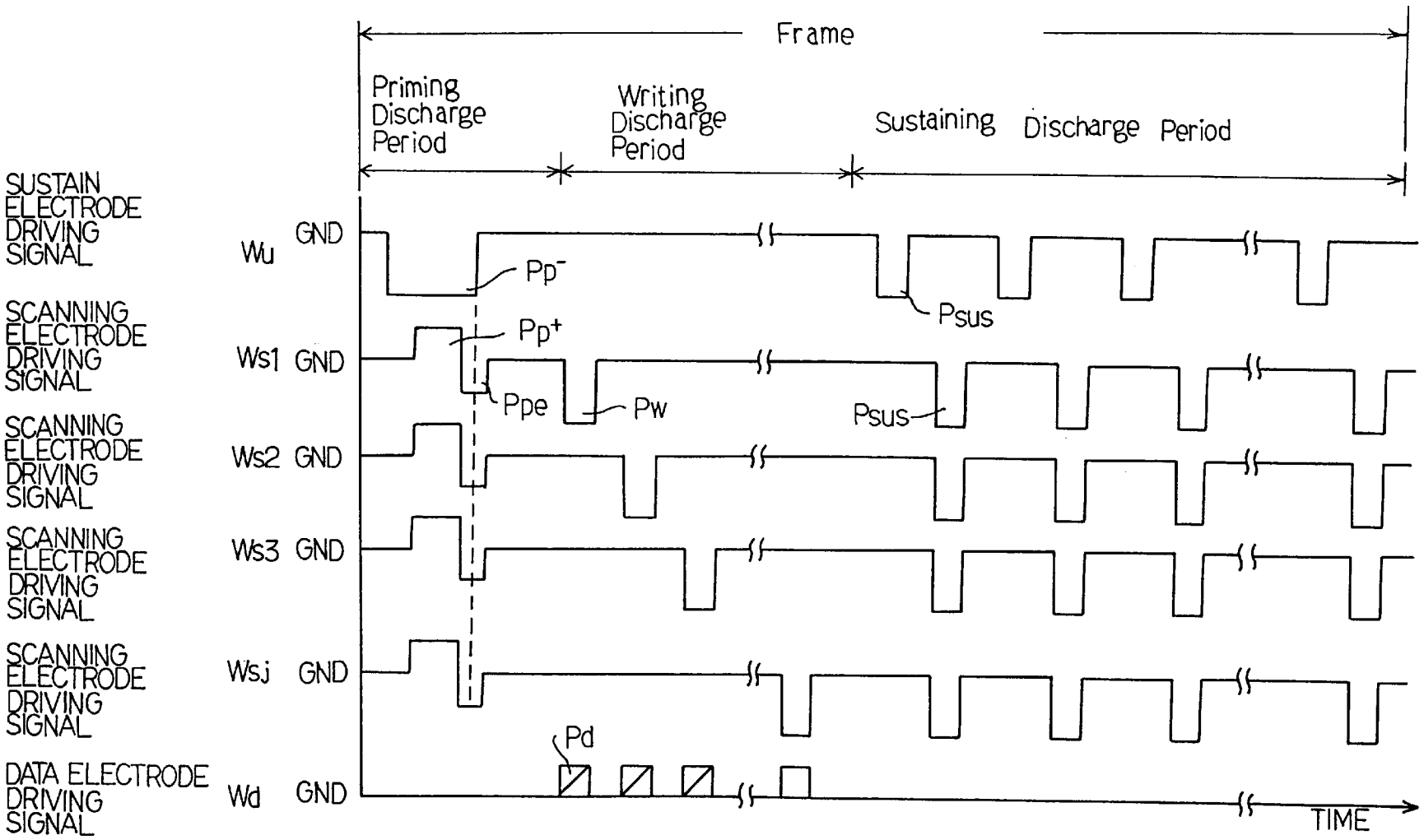
FIG. 9 is a timing chart showing yet another controlling sequence for a plasma display panel according to the present invention.

FIG. 9 illustrates yet another controlling sequence embodying the present invention. A frame is also divided into a priming discharge period, a writing discharge period and a sustaining discharge period. The controlling method is similar to the controlling method implementing the second embodiment except for the delay between the fall of the negative priming discharge pulse Pp− and the rise of the positive priming discharge pulse Pp+. The delay time is approximately equal to the pulse width of the sustain pulse Psus in the sustaining discharge period. The negative priming erase discharge pulse Ppe also delays the rise of the negative priming discharge pulse Pp− from the fall of the positive priming discharge pulse Pp+.

The frame is repeated in the actual image formation. Assuming now that a certain indicating cell was fired during the sustaining discharge period in the previous frame, the wall charge has been accumulated in the certain indicating cell due to the last sustain pulse Psus applied to the associated scanning electrode, and a potential due to the wall charge is added to the negative priming discharge pulse Pp−, and promotes discharge in the presence of the negative priming discharge pulse Pp−. However, the wall potential produced at the discharge cancels the positive priming, discharge pulse Pp+, and no discharge takes place at the rise of the positive priming discharge pulse Pp+. In this instance, the negative priming discharge pulse Pp− and the positive priming discharge pulse Pp+ are not concurrently applied to the sustain electrodes Su1 to Suj and the scanning electrodes Sc1 to Scj, and the time delay is introduced. For this reason, the effective potential applied to the certain indicating cell is decreased, and the certain indicating cell is faintly fired. This results in that the luminance is further decreased in the priming discharge period.

On tie other hand, as to an indicating cell that was not fired in the previous frame, no wall discharge has been accumulated in the sustaining discharge period, and any discharge does not take place at the fall of the negative priming discharge pulse Pp−. When the positive priming discharge pulse Pp+ is applied to the associated scanning electrode, the indicating cell is fired between the associated Sustain electrode and tie associated scanning electrode.

The plasma display panel behaves as similar to that of the first embodiment after the priming discharge, and the negative priming erase discharge pulse Ppe decreases the peak current as similar to that of the second embodiment.

Fourth Embodiment

Figure 10:
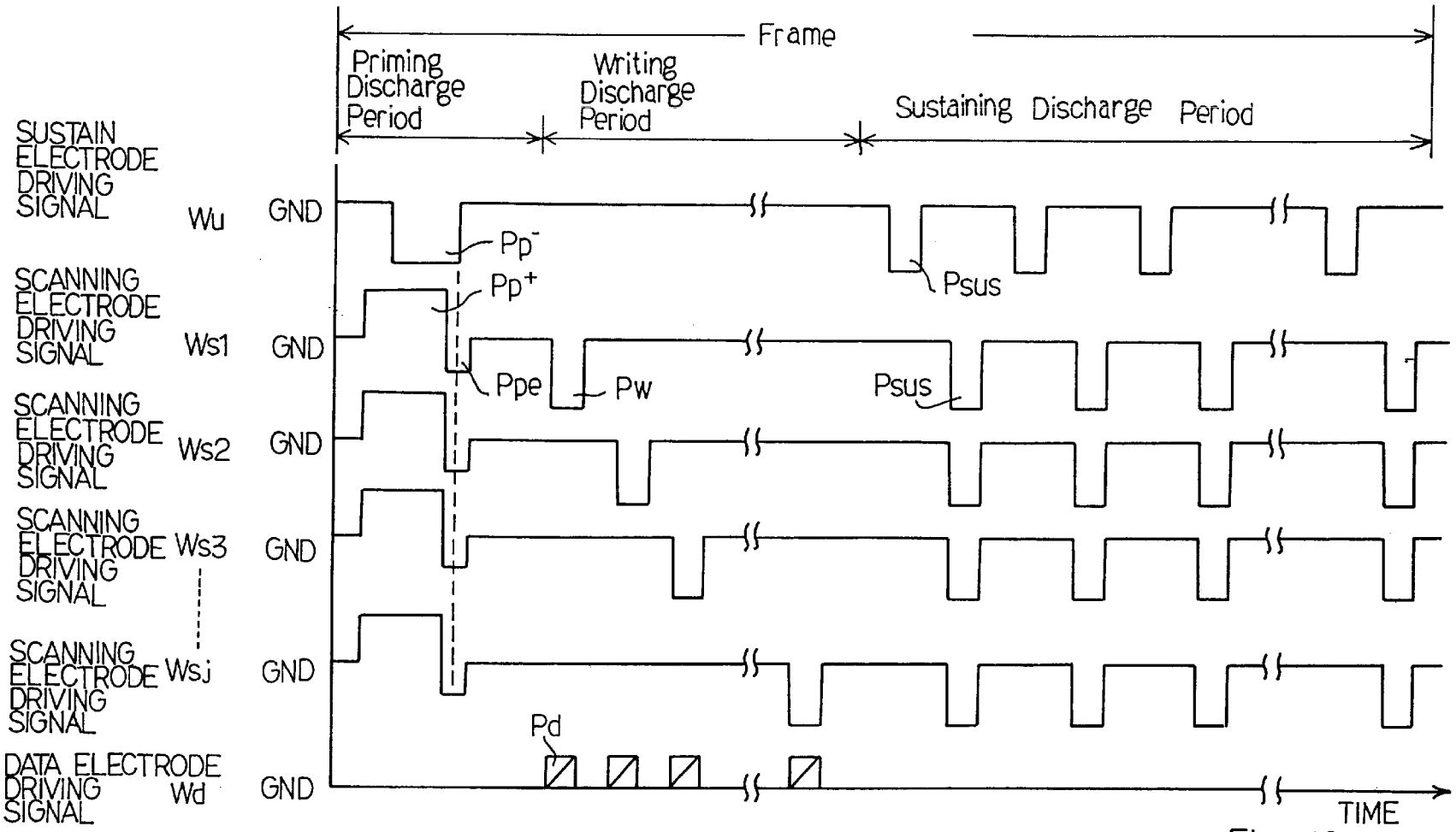
FIG. 10 is a timing chart showing still another controlling sequence for a plasma display panel according to the present invention.

FIG. 10 illustrates still another controlling sequence for a plasma display panel embodying the present invention. A frame is also divided into a priming discharge period, a writing discharge period and a sustaining discharge period, and a visual image is produced on a screen of the plasma display panel through the selective firing in the writing/sustaining discharge periods.

The controlling method implementing the fourth embodiment is similar to the second embodiment except for the fall of the negative priming discharge pulse Pp− delayed from the rise of the positive priming discharge pulse Pp+ in the priming discharge period. The time period between the rise of the positive priming discharge pulse Pp+ and the fall of the negative priming discharge pulse Pp− is approximately equal to the pulse width of the sustain pulse Psus in the sustaining discharge period.

In this instance, a potential due to the positive wall charge generated at the negative sustain pulse Psus is added to the positive priming discharge pulse Pp+ for an indicating cell that was fired in the previous frame, and the indicating cell is fired at the rise of the positive priming discharge pulse Pp+. However, the wall charge generated at the discharge cancels the negative priming discharge pulse Pp−, and any discharge takes place at the fall of the negative priming discharge pulse Pp−. However, the time delay is introduced between the rise of the positive priming discharge pulse Pp+ and the fall of the negative priming discharge pulse Pp−. The effective potential is decreased, and the indicating cell is faintly fired in the priming discharge period. For this reason, the luminance is further decreased in the priming discharge period.

On the other hand, an indicating cell that was not fired in the previous frame is not fired at the rise of the positive priming discharge pulse Pp+, because the wall charge was not accumulated in the sustaining discharge period in the previous frame. The indicating cell is fired at the fall of the negative priming discharge pulse Pp−.

The plasma display panel behaves as similar to the first and second embodiment after the priming discharge, and no further description is incorporated hereinbelow for the sake of simplicity.

Fifth Embodiment

Figure 11:
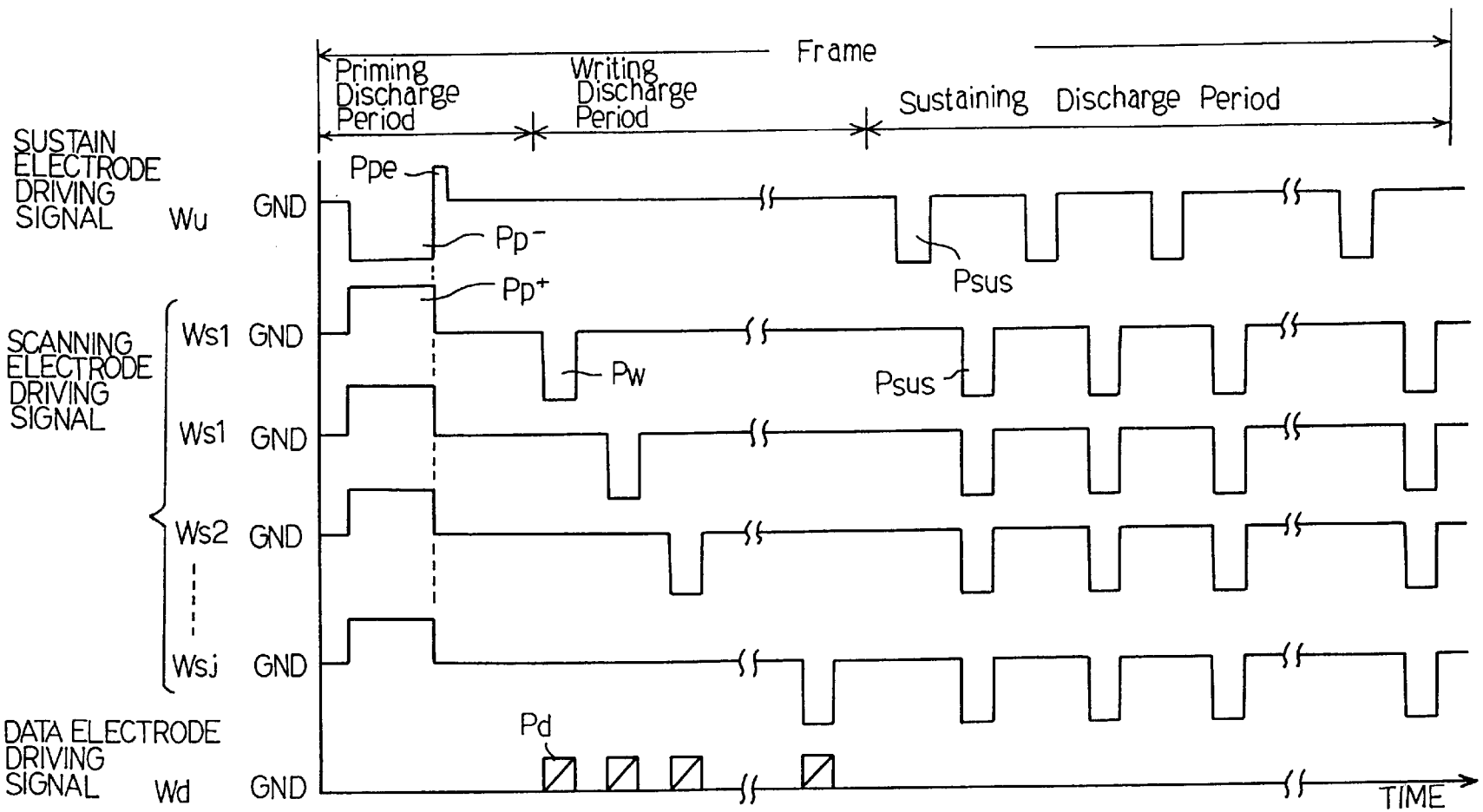
FIG. 11 is a timing chart showing another controlling sequence for a plasma display panel according to the present invention.

FIG. 11 illustrates another method of controlling a plasma display panel embodying the present invention. A frame is also divided into a priming discharge period, a writing discharge period and a sustaining discharge period, and the plasma display panel produces a visual image on the screen through selective firing in the writing/sustaining discharge periods.

The control sequence shown in FIG. 11 is similar to that of the first embodiment except for a positive priming erase discharge pulse Ppe concurrently applied to the sustain electrodes Su1 to Suj. For this reason, description is focused on the positive priming erase discharge pulse Ppe.

The positive priming erase discharge signal Ppe rises at the rise of the negative priming discharge pulse Pp−, and is fallen after certain time period as short as the minimum erasing pulse width ranging from 0.5 microsecond to 2 microsecond and, preferably, from 0.5 microsecond to 1 microsecond.

The distribution of the wall charge is similar to that shown in FIG. 7A before the application of the erase pulse signal Ppe. When the positive priming erase pulse signal Ppe is applied to the sustain electrodes Su1 to Suj, discharge takes place between the sustain electrodes Su1 to Suj and the scanning electrodes Sc1 to Scj, and the discharge erases the two kinds of wall charge from the surface beneath the scanning/sustain electrodes Sc1 to Scj and Su1 to Suj. The positive priming erase discharge signal Ppe induces the positive wall charge more than that of the first embodiment on the surface over the data electrodes D1 to Dk, because the data electrodes D1 to Dk are negative with respect to the sustain electrodes Su1 to Suj. The large amount of positive wall charge makes the write-in discharge certain.

In the above described embodiments, the negative priming erase discharge pulse Ppe is applied to the scanning electrodes Sc1 to Scj, or the positive priming erase discharge signal Ppe is alternatively applied to the sustain electrodes Su1 to Suj. If the negative priming erase discharge pulse Ppe is too large in pulse amplitude, a certain structure of plasma display unit or certain discharge gas allows discharge to take place between the scanning electrodes Sc1 to Scj and the data electrodes D1 to Dk as well as between the scanning electrodes Sc1 to Scj and the sustain electrodes Su1 to Suj. In this situation, the data electrodes D1 to Dk serve as an anode with respect to the scanning electrodes Sc1 to Scj, and a large amount of negative wall charge is accumulated in the surface over the data electrodes D1 to Dk close to the scanning electrodes Sc1 to Scj after the priming erase discharge. The negative wall charge partially cancels the write-in pulse Pw, and the plasma display panel requires the write-in pulse Pw with a large pulse amplitude for the write-in discharge.

The fifth embodiment also encounters the problem. If the positive priming erase discharge pulse Ppe has a large pulse amplitude, a certain plasma display panel or certain discharge gas allows discharge to take place between the sustain electrodes Su1 to Suj and the data electrodes D1 to Dk as well as between the scanning electrodes Sc2 to Scj and the sustain electrodes Su1 to Suj. In this situation, the data electrodes D1 to Dk serve as a cathode with respect to the sustain electrodes Su1 to Suj, and the phosphor layers are undesirably subjected to ion bombardment. The ion bombardment deteriorates the phosphor layers, and the luminance is reduced. The sixth and seventh embodiments aim at solution of the above described problems.

Sixth Embodiment

FIG. 7 illustrates a method of controlling a plasma display panel embodying the present invention. A frame is also divided into a priming discharge period, a writing discharge period and a sustaining discharge period, and the plasma display panel produces a visual image on a screen through a selective firing in the writing discharge period and the sustaining discharge period.

Figure 12:
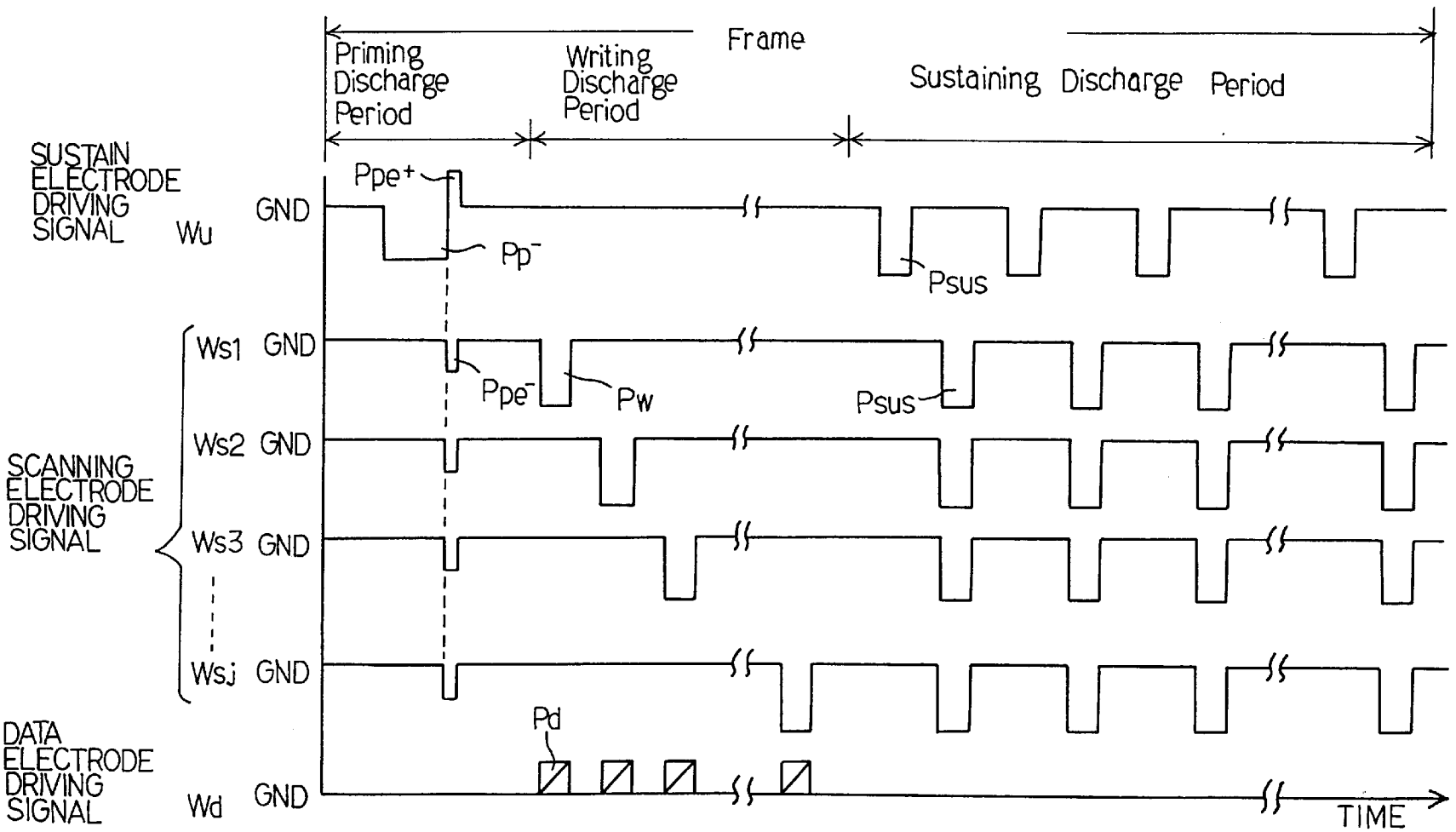
FIG. 12 is a timing chart showing a controlling sequence for a plasma display panel according to the present invention.

The writing discharge period and the sustaining discharge period shown in FIG. 12 are similar to those of the first embodiment, and description is focused on the priming discharge period only. In the priming discharge period, a negative priming discharge pulse Pp− is concurrently applied to the sustain electrodes Su1 to Suj. The negative priming discharge pulse Pp− has the pulse amplitude ranging between 300 volts and 400 volts and the pulse width ranging between 5 microseconds to 20 microseconds, and fires all the indicating cells. While the negative priming discharge pulse Pp− is being applied to the sustain electrodes Su1 to Suj, the scanning electrodes Sc1 to Scj are held in the ground level.

After the priming discharge due to the negative priming discharge pulse Pp−, a negative priming erase discharge pulse Ppe− is applied to the scanning electrodes Sc1 to Scj, and a positive priming erase discharge pulse Pp+ is applied to the sustain electrodes Su1 to Suj. The negative priming erase discharge pulse Ppe− has the pulse amplitude ranging from 50 volts to 150 volts, and the positive priming erase discharge pulse Ppe+ also has the pulse amplitude ranging from 50 volts to 150 volts. Both of the positive erase discharge pulse Ppe+ and the negative erase discharge pulse Pp− have the pulse width as narrow as the minimum erasing pulse width ranging from 0.5 microsecond to 2 microsecond and, preferably, from 0.5 microsecond to 1 microsecond.

The rise of the positive priming erase discharge pulse Ppe+ and the fall of the negative priming erase discharge pulse Ppe− are synchronous with the rise of the negative priming discharge pulse Pp−.

Figure 13A:
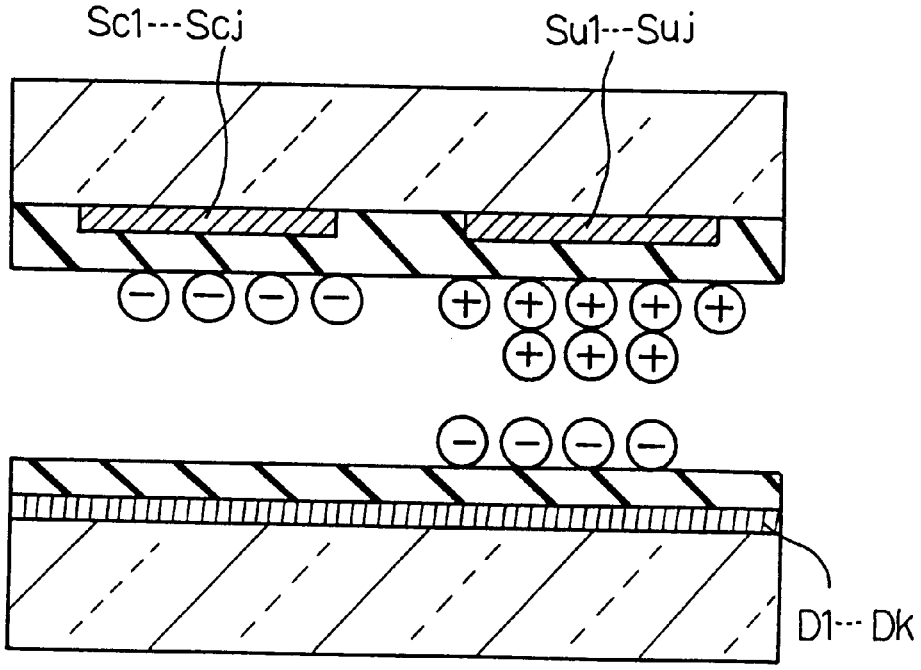
FIGS. 13A and 13B are cross sectional views showing wall charge before and after priming erase discharge.

The priming discharge produces the positive wall charge and the negative wall charge on the surface beneath the sustain electrodes Su1 to Suj and the surface beneath the scanning electrodes Sc1 to Scj, and the negative wall charge is accumulated in the surface over the data electrodes D1 to Dk close to the sustain electrodes Su1 to Suj as shown in FIG. 13A. When the positive priming erase discharge pulse Ppe+ and the negative priming erase discharge pulse Ppe− are applied to the sustain electrodes Su1 to Suj and the scanning electrodes Sc1 to Scj, potential due to the wall charge is added thereto, and discharge takes place between the scanning electrodes Sc1 to Scj and the sustain electrodes Su1 to Suj. The priming erase discharge pulses Ppe+ and Ppe− are positive and negative with respect to the data electrodes D1 to Dk, and the pulse amplitudes thereof are expected to generate the discharge between the sustain electrodes Su1 to Suj and the scanning electrodes Sc1 to Scj. For this reason, the total amplitude between the positive priming erase discharge pulse Ppe+ and the negative priming erase discharge pulse Ppe− is regulated to a certain value equal to or greater than the firing potential between the scanning electrodes Sc1 to Scj and the sustain electrodes Su1 to Suj. For this reason, the positive priming erase discharge pulse Ppe+ and the negative priming erase discharge pulse Ppe− are smaller in pulse amplitude than the single erase discharge pulse used in the first to fifth embodiments.

Figure 13B:
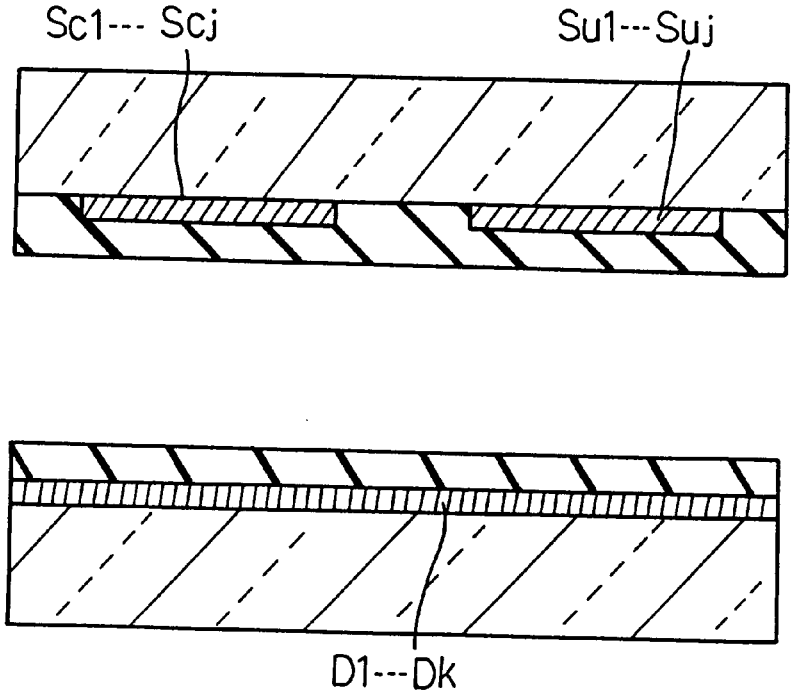

If the positive erase discharge pulse Ppe+ and the negative erase discharge pulse Ppe− are regulated in such a manner as to have appropriate pulse amplitudes and appropriate pulse widths for faint discharge between the sustain electrodes Su1 to Suj and the data electrodes D1 to Dk, the wall charge is perfectly erased from not only the surfaces beneath the sustain/scanning electrodes Su1/Sc1 to Suj/Scj but also the surface over the data electrodes D1 to Dk as shown in FIG. 13B.

As described hereinbefore, the negative wall charge over the data electrodes D1 to Dk cancels a part of the data pulse Pd, and causes the manufacturer to increase the pulse amplitude of the write-in pulse Pw. The method can erase the negative wall charge on the data electrodes D1 to Dk, and allows the manufacturer to decrease the pulse amplitude of the write-in pulse Pw.

Seventh Embodiment

Figure 14:
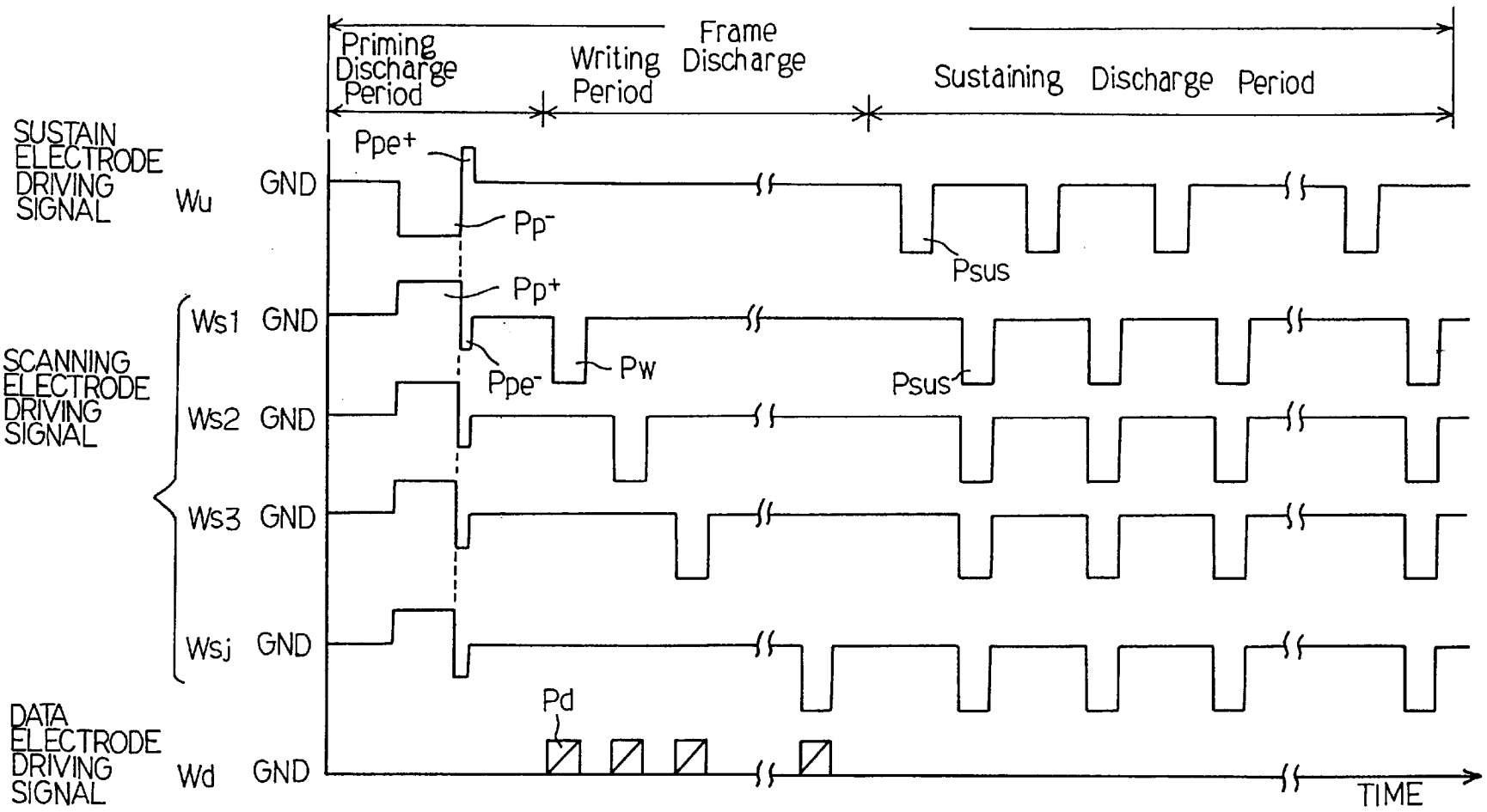
FIG. 14 is a timing chart showing another controlling sequence for a plasma display panel according to the present invention.

FIG. 14 illustrates another controlling sequence for a plasma display panel embodying the present invention. A frame is also divided into a priming discharge period, a writing discharge period and a sustaining discharge period. The writing discharge period and the sustaining discharge period are similar to those of the first embodiment, and description is focused on the priming discharge period. A negative priming discharge pulse Pp− and a positive priming discharge pulse Pp+ are respectively applied to the sustain electrodes Su1 to Suj and the scanning electrodes Sc1 to Scj in synchronism with each other. The negative priming discharge pulse Pp− has the pulse amplitude ranging from 170 volts to 200 volts, and has the pulse width ranging from 5 microseconds to 20 microseconds. The positive priming discharge pulse also has the pulse amplitude ranging from 170 volts to 200 volts, and has the pulse width ranging from 5 microseconds to 20 microseconds.

Subsequently, a positive priming erase discharge pulse Ppe+ is applied to the sustain electrodes Su1 to Suj in synchronism with the rise of the negative priming discharge pulse Pp−, and a negative priming erase discharge pulse Ppe− is applied to the scanning electrodes Sc1 to Scj in synchronism with the fall of the positive priming discharge pulse Pp+. The positive priming erase discharge pulse Pp+ ranges from 50 volts to 150 volts in pulse amplitude, and the negative priming erase discharge pulse Ppe− also has the pulse amplitude ranging from 50 volts to 150 volts. The positive priming erase discharge pulse Ppe+ and the negative priming erase discharge pulse Ppe− are as narrow as the minimum erase pulse width ranging from 0.5 microsecond to 2 microseconds and, preferably, from 0.5 microsecond to 1 microsecond.

After the priming discharge, two kinds of wall potential are accumulated as similar to the first embodiment shown in FIG. 7A. The negative wall charge is accumulated in the surface portion beneath the scanning electrodes Sc1 to Scj, and the positive wall charge is accumulated in the surface portion beneath the sustain electrodes Sc1 to Scj. On the other hand, the surface portion over the data electrodes D1 to Dk close to the scanning electrodes Sc1 to Scj accumulates the positive wall charge, and the negative wall charge is accumulated in the surface portion over the data electrodes D1 to Dk close to the sustain electrodes Su1 to Suj.

In this instance, the priming erase discharge pulses Ppe− and Ppe+ are negative and positive with respect to the potential level on the data electrodes D1 to Dk, and the pulse amplitude is equal to or greater than the firing potential between the scanning electrodes Sc1 to Scj and the sustain electrodes Su1 to Suj. In other words, the negative priming erase pulse Ppe− and the positive priming erase pulse Ppe+ are expected to have the total potential difference equal to or greater than the firing potential between the sustain electrodes Su1 to Suj and the scanning electrodes Sc1 to Scj. Thus, each of the negative priming erase discharge pulse Ppe− and the positive priming, erase discharge pulse Ppe+ is allowed to be lower than the single priming erase discharge pulse applied to either sustain or scanning electrodes.

When the potential difference between the positive priming discharge pulse Pp+ and the negative priming discharge pulse Pp− exceeds the firing potential between the scanning electrodes Sc1 to Scj and the sustain electrodes Su1 to Suj, discharge takes place between the scanning electrodes Sc1 to Scj and the sustain electrodes Su1 to Suj. However, the potential difference between the priming discharge pulse Pp−/Pp+ and the ground level does not exceed the firing potential between the sustain/scanning electrodes Su1/Sc1 to Suj/Scj and the data electrodes D1 to Dk, and any discharge takes place therebetween.

Moreover, the pulse amplitude of the positive priming erase discharge pulse Ppe+ is so small that any discharge does not take place between the sustain electrodes Su1 to Suj and the data electrodes D1 to Dk. For this reason, positive electric charge does not bombard the phosphor layers, and the phosphor layers are never deteriorated. Moreover, no discharge takes place between the scanning electrodes Sc1 to Scj and the data electrodes D1 to Dk, and negative wall charge, which cancels a part of the data pulse, is never accumulated in the surface portion over the data electrodes D1 to Dk.

As will be appreciated from the foregoing description, the positive priming discharge pulse/the negative priming discharge pulse are applied to the scanning electrodes and the sustain electrodes according to the present invention, or the positive priming erase discharge pulse/the negative priming erase discharge pulse are applied to the scanning electrodes and the sustain electrodes after the priming discharge according to the present invention. The positive/negative pulses make the priming discharge or the priming erase discharge weak, and reduce the luminance in the priming discharge period. Moreover, the phosphor layers are prevented from the bombardment, and are improved in durability. Thus, the controlling method according to the present invention achieves a large contrast in the plasma display panel.

Moreover, the indicating cells are selectively fired by using a low-potential write-in pulse, and the reproducibility of an visual image is improved.

Although particular embodiments of the present invention have been shown and described, it will be obvious to those skilled in the art that various changes and modifications may be made without departing from the spirit and scope of the present invention.

For example, the negative priming erase discharge pulse Ppe shown in FIG. 9 or 10 may be fallen in synchronism with the rise of the negative priming discharge pulse.

The positive priming erase pulse Ppe shown in FIG. 11 may rise earlier than the fall of the positive priming discharge pulse Pp+ by 1 microsecond to 5 microseconds. The rise of the positive priming discharge pulse Pp+ shown in FIG. 11 may be delayed from the fall of the negative priming discharge pulse Pp− by the pulse width of the negative sustain pulse Psus, or the fall of the negative priming discharge pulse Pp− may be delayed from the rise of the positive priming discharge pulse Pp+ by the pulse width of the negative sustain pulse Psus. The time delay may be also introduced into the controlling sequence implementing the seventh embodiment.

It is unnecessary for the priming erase discharge pulse or pulses to be synchronous with the rise of the negative priming discharge pulse or/and the fall of the positive priming discharge pulse. The priming erase discharge pulse may be separated from the priming discharge pulse.

In the seventh embodiment, the two kinds of priming erase discharge pulse are synchronously changed. However, the two kinds of priming erase discharge pulse may be delayed from each other in so far as they are partially overlapped with each other.

In the above embodiments, the data electrodes D1 to Dk are maintained at the ground voltage in the priming discharge period. However, the data electrodes D1 to Dk may be biased to a negative potential level or a positive potential level in so far as the three electrodes Sc1–Scj, Su1–Suj and D1 to Dk satisfy the above described relative relation.

The negative priming discharge pulse and the positive priming discharge pulse may be applied to the scanning electrodes Sc1 to Scj and the sustain electrodes Su1 to Suj in the opposite manner to the above described embodiments.

The priming erase discharge pulse may be deleted from the controlling sequence implementing the first to fourth embodiments so that the write-in pulse Pw and the data pulse Pd immediately follow the priming discharge pulses Pp−/Pp+.

A wide low-potential erase pulse or an erase pulse as narrow in pulse width as the sustain pulse Psus may be applied to the electrodes at the final stage in the sustaining discharge period so as to erase the wall charge.

Finally, the pulse amplitude and the pulse width are adjusted to suitable values for the plasma display panel, and are not limited to the values described in the embodiments.

What is claimed is:

1. A method of controlling a plasma display panel having a plurality of scanning electrodes, a plurality of sustaining electrodes respectively paired with said plurality of scanning electrodes and a plurality of data electrodes defining a plurality of indicating cells together with the pairs of scanning and sustaining electrodes, comprising the steps of:

a) respectively applying a first priming discharge pulse of a first polarity and a second priming discharge pulse of a second polarity opposite to said first polarity with respect to a potential level on said plurality of data electrodes to said plurality of sustaining electrodes and said plurality of scanning electrodes in such a manner that at least a part of said first priming discharge pulse is overlapped with a part of said second priming discharge pulse in a priming discharge period;

b) selecting certain indicating cells from said plurality of indicating cells for firing said certain indicating cells through a write discharge selectively generated between said plurality of scanning electrodes and said plurality of data electrodes in a writing discharge period after said priming discharge period; and c) continuing said firing in said certain indicating cells by applying a sustain pulse to said plurality of scanning electrodes and said plurality of sustaining electrodes in a sustaining discharge period after said writing discharge period.

2. The method as set forth in claim 1, in which a potential difference between said first priming discharge pulse and said second priming discharge pulse is equal to or greater than a firing potential between said plurality of scanning electrodes and said plurality of sustaining electrodes, and a potential difference between said first priming discharge pulse and said potential level on said plurality of data electrodes and a potential difference between said second priming discharge pulse and said potential level on said plurality of data electrodes are less than a firing potential between said plurality of sustaining electrodes and said plurality of data electrodes and a firing potential between said plurality of scanning electrodes and said plurality of data electrodes, respectively.

3. The method as set forth in claim 1, in which a priming erase discharge pulse of said first polarity is applied to said plurality of scanning electrodes after said second priming discharge pulse in said priming discharge period.

4. The method as set forth in claim 3, in which the trailing edge of said second priming discharge pulse is aligned with the leading edge of said priming erase discharge pulse.

5. The method as set forth in claim 4, in which the trailing edge of said first priming discharge pulse is delayed from said trailing edge of said second priming discharge pulse and said leading edge of said priming erase discharge pulse.

6. The method as set forth in claim 4, in which the trailing edge of said first priming discharge pulse is delayed from said trailing edge of said second priming discharge pulse and said leading edge of said priming erase discharge pulse, and the leading edge of said second priming discharge pulse is delayed from the leading edge of said first priming discharge pulse.

7. The method as set forth in claim 4, in which the trailing edge of said first priming discharge pulse is delayed from said trailing edge of said second priming discharge pulse and said leading edge of said priming erase discharge pulse, and the leading edge of said first priming discharge pulse is delayed from the leading edge of said second priming discharge pulse.

8. The method as set forth in claim 1, in which a priming erase discharge pulse of said second polarity is applied to said plurality of sustaining electrodes after said first priming discharge pulse in said priming discharge period.

9. The method as set forth in claim 8, in which the trailing edge of said first priming discharge pulse is aligned with the leading edge of said priming erase discharge pulse.

10. A method of controlling a plasma display panel having a plurality of scanning electrodes, a plurality of sustaining electrodes respectively paired with said plurality of scanning electrodes and a plurality of data electrodes defining a plurality of indicating cells together with the pairs of scanning and sustaining electrodes, comprising the steps of:

a) applying a priming discharge pulse of a negative potential level with respect to a potential level on said plurality of data electrodes to one of said plurality of sustaining electrodes and said plurality of scanning electrodes in said priming discharge period;

b) respectively applying a first priming erase discharge pulse of a positive potential level with respect to said plurality of data electrodes and a second priming erase discharge pulse of a negative potential level with respect to said plurality of data electrodes to said one of said plurality of sustaining electrodes and said plurality of scanning electrodes and the other of said plurality of sustaining electrodes and said plurality of scanning electrodes in such a manner that a part of said first priming erase discharge pulse is overlapped with a part of said second priming erase discharge pulse after said priming discharge pulse in said priming discharge period;

c) selecting certain indicating cells from said plurality of indicating cells for firing said certain indicating cells through a write discharge selectively generated between said plurality of scanning electrodes and said plurality of data electrodes in a writing discharge period after said priming discharge period; and d) continuing said firing in said certain indicating cells by applying a sustain pulse to said plurality of scanning electrodes and said plurality of sustaining electrodes in a sustaining discharge period after said writing discharge period.

11. The method as set forth in claim 10, in which a potential difference between said first priming erase discharge pulse and said second priming discharge pulse is equal to or greater than a firing potential between said plurality of scanning electrodes and said plurality of sustaining electrodes, and a potential difference between said first priming erase discharge pulse and said potential level on said plurality of data electrodes and a potential difference between said second priming discharge pulse and said potential level on said plurality of data electrodes are less than a firing potential between said one of said plurality of sustaining electrodes and said plurality of scanning electrodes and said plurality of data electrodes and a firing potential between said other of said plurality of sustaining electrodes and said plurality of scanning electrodes and said plurality of data electrodes, respectively.

12. The method as set forth in claim 10, in which another priming discharge pulse of a positive potential level is applied to said other of said plurality of sustaining electrodes and said plurality of scanning electrodes in such a manner that a part of said another priming discharge pulse is overlapped with a part of said priming discharge pulse before said first and second priming erase discharge pulses.

* * * * *

UNITED STATES PATENT AND TRADEMARK OFFICE

CERTIFICATE OF CORRECTION

PATENT NO. : 6,118,416
DATED : September 12, 2000
INVENTOR(S) : Tadashi Nakamura, et al It is certified that error appears in the above-identified patent and that said Letters Patent is hereby corrected as shown below:

Column 8, line 34, delete "Su1/Sc1" insert --suj/sc1--

Column 9, line 39, delete "tie" insert --the--;

line 40, delete "discharge" insert --charge--;

line 46, delete "Sustain" insert --sustain--;

line 46, delete "tie" insert --the--

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*